United States Patent [19]

Dilling

[11] 3,998,083

[45] Dec. 21, 1976

[54] STRAIGHTENING APPARATUS

[75] Inventor: E. Donald Dilling, Albany, Oreg.

[73] Assignee: Kawecki Berylco Industries, Inc., Reading, Pa.

[22] Filed: Aug. 11, 1975

[21] Appl. No.: 603,689

[52] U.S. Cl. ..... 72/81; 72/95; 29/DIG. 41

[51] Int. Cl.[2] ..... B21D 3/00

[58] Field of Search ..... 72/77, 79, 80, 81, 95, 72/98, 99, 100; 29/DIG. 41

[56] References Cited

UNITED STATES PATENTS 1,936,765 11/1933 Lawson ..... 72/95

*Primary Examiner*—Lowell A. Larson

*Attorney, Agent, or Firm*—Kolisch, Hartwell, Dickinson & Stuart

[57] ABSTRACT

Straightening apparatus with means for rotating an elongate work element and advancing the same along its longitudinal axis. A bending station is provided in the apparatus which bends the rotating work element when such is advanced therethrough. The bending station includes infeed and outfeed parts mounted for relative universal movement on a central confining member. A tapered work element is confined within a sheathing device to produce an assembly of uniform diameter for processing by the apparatus.

10 Claims, 9 Drawing Figures

STRAIGHTENING APPARATUS

This invention relates to straightening apparatus, and more particularly, to apparatus which may be employed to straighten an elongate work element to remove deviations from linearity therein, by back and forth bending of the element across its longitudinal axis applied incrementally along such axis.

A general object of this invention is to provide improved apparatus of this description which accomplishes the bending operation in a unique and highly practical manner.

Another object is to provide such apparatus which affords ready control of the amount of deformation applied to the work element during the bending operation.

The apparatus of the invention has particular utility in straightening rods or tubing which have a taper extending along their length, which do not lend themselves to being straightened using ordinary types of straightening equipment.

Further explaining, in straightening an article such as a tapered tube, where the diameter of such article is considerably larger at one end than its opposite end, optimumly the amount of bending applied to the smaller diameter end of the article will exceed the amount of bending applied to the larger diameter end. Thus, a bending action which is appropriate for the smaller diameter end may be excessive for the larger diameter end, so as to cause fracture or other breakdown in the article, and conversely, a bending action selected for the larger diameter end might be insufficient to produce straightening in the smaller diameter end. The apparatus of the invention is particularly appropriate for the straightening of such an article, since the apparatus includes novel means for varying the bending action imparted to an article as the same progresses therethrough.

The straightening of a tapered work element raises a further problem, in that any instrumentality in the apparatus functioning to confine the work element during the straightening process, if set to confine one diameter, will have an improper setting for other portions of the article having different diameters. Further explaining, a conventional form of straightener includes opposed rollers, with the axes of the rollers canted with respect to each other. A rod or tube being straightened passes between such rollers, with these rollers and others like them provided in the path of the article as such advances. The rollers are operable to bend the article back and forth with advancing of the article through the rollers. Obviously, if the spacing of these rollers is selected for the small diameter end of the article, the spacing will be insufficient for processing the larger diameter end, and conversely, a spacing selected for the larger diameter end will be ineffective properly to confine the smaller diameter end.

Another object of the invention, therefore, is to provide novel straightening apparatus which is particularly adapted for the straightening of tapered work elements by the inclusion of means enabling the amount of bending applied to the work element to be varied, and with such variation coordinated with the change in the diameter of the work element as such progresses through the apparatus.

Yet a further object is to provide apparatus for straightening tapered work elements, which in a practical manner takes care of the problem of confinement of the work element at large and small diameter ends, and portions of varying diameter existing between these ends.

These and other objects and advantages of the invention will become more fully apparent from the following description, which is to be taken in conjunction with the accompanying drawings, wherein.

Figure 1:
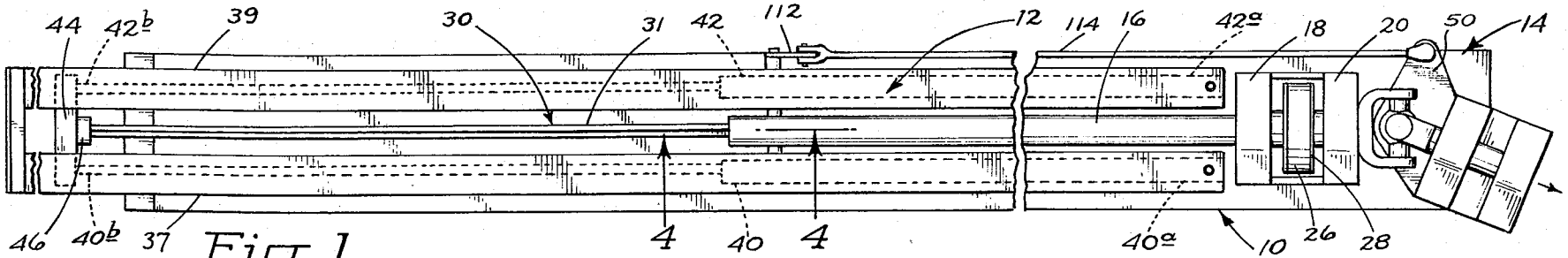
FIG. 1 is a plan view illustrating apparatus constructed according to an embodiment of the invention.
Figure 2:
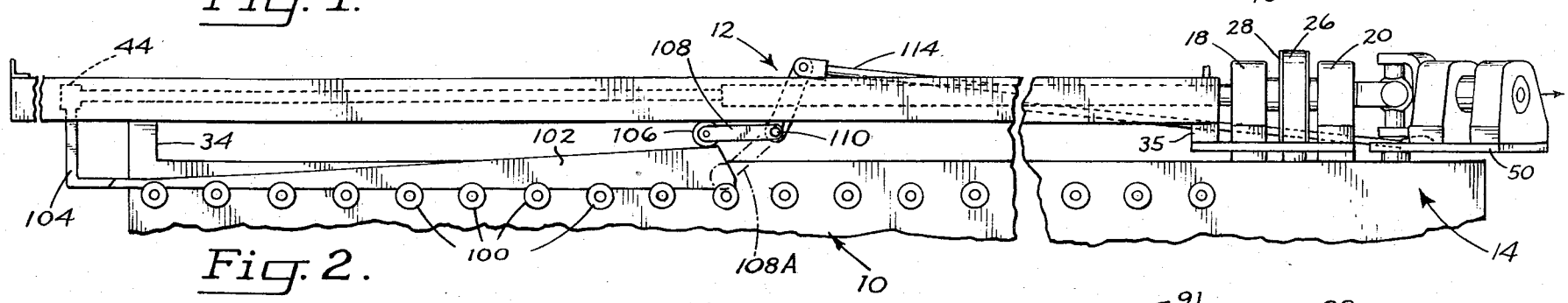
FIG. 2 is a side elevation of the apparatus pictured in FIG. 1.

Referring to the drawings, and first of all more particularly to FIGS. 1 and 2, the apparatus illustrated comprises a frame 10 ordinarily resting on the floor. Supported adjacent the top of frame 10 is a means generally indicated at 12 operable to advance an elongate work element while at the same time rotating the work element about its longitudinal axis. Indicated at 14 is means forming a bending station which, as will be described, is operable to bend the work element back and forth across its longitudinal axis, as the work element is progressed through the station.

Figure 4:
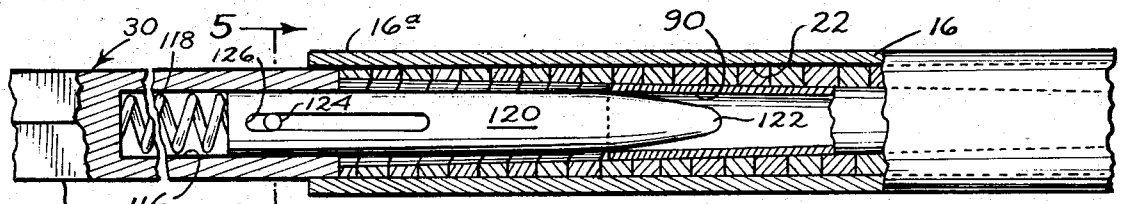
FIG. 4 is a view, somewhat enlarged and partially broken away, taken generally along the line 4—4 in FIG. 1.
Figure 5:
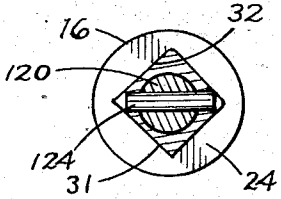
FIG. 5 is a cross-sectional view taken along the line 5—5 in FIG. 4.

Considering first of all details of advancing means 12, such includes an elongate mounting or cylinder 16, which is rotatably supported in the apparatus for rotation about its longitudinal axis in suitable bearings disposed within pillow blocks 18, 20. Referring to FIGS. 4 and 5, the mounting or cylinder 16 includes a cylindrical bore 22 extending throughout the length of the mounting, save for an end region **16*a* where such bore is partially closed off by a wall 24. Mounting or cylinder 16 is rotated under power by means including a belt 26 and a pulley 28, with the belt being driven by a suitable drive motor (not shown). With rotation of the mounting the same is rotated about the axis of bore 22**.

Also part of advancing means 12 is a pusher means 30 including an elongate rod element 31 of polygonal (square) cross section. Wall 24 earlier described has a passage 32 extending therethrough having a polygonal outline matching the cross section of the rod element in pusher means 30. The rod element extends through this passage, and by reason of the noncircular, i.e., polygonal shape described, rotation of mounting or cylinder 16 is also imparted to the rod element.

Supported above frame 10 through bracket structures 34, 35 are a pair of parallel, elongate rail or track members 37, 39, having a fixed position in the apparatus. Housed within each rail member is an elongate, fluid-operated ram, shown for the rail members at 40 and 42, respectively. The cylinder ends **40*a*, 42*a* of these rams are suitably anchored within the rail members. The extensible rod ends 40***b*, 42*b* of these rams are interconnected by a crosspiece 44 which spans the outer extremities of the rod ends. The crosspiece is guided by the rail members for movement in a path generally paralleling the rail members. Rod element 31 in the pusher means has its left extremity in FIG. 1 relatively rotatably connected to the crosspiece by journal means 46.

From the construction described, it should be apparent that with contraction of the rams 40, 42 from the almost fully extended positions shown in FIG. 1, the crosspiece is caused to move from left to right, with such being effective to push rod element 31 further into the mounting or cylinder, 16, any powered rotation of the cylinder or mounting 16 at the same time being imparted to the rod element.

Figure 6:
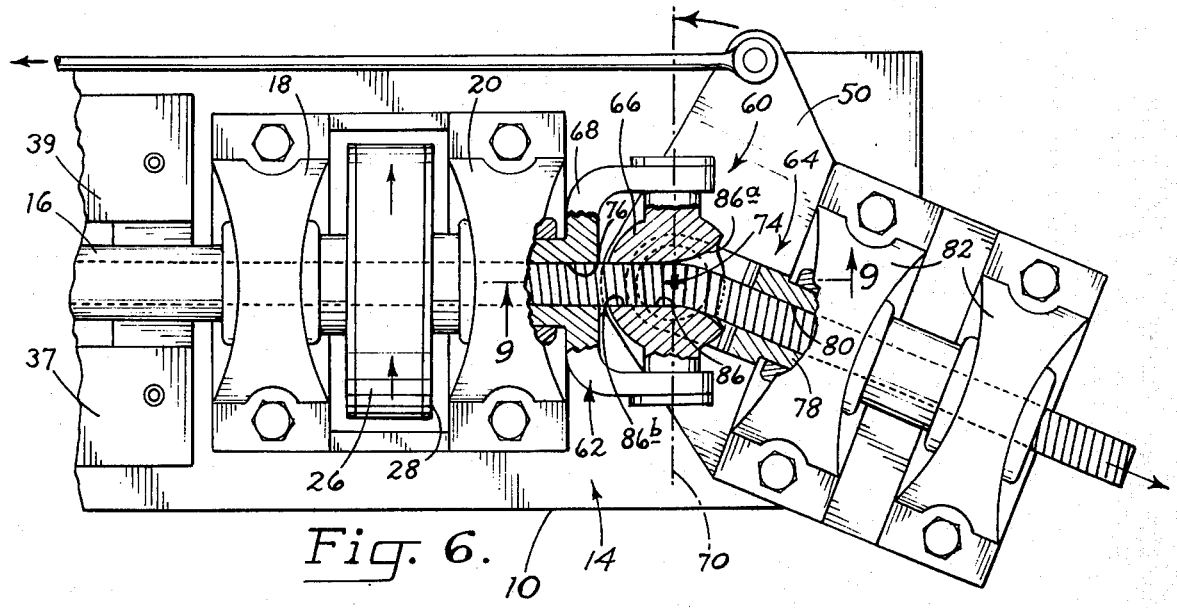
FIG. 6 is an enlarged view, partially broken away, illustrating the offbearing end of the apparatus.
Figure 7:
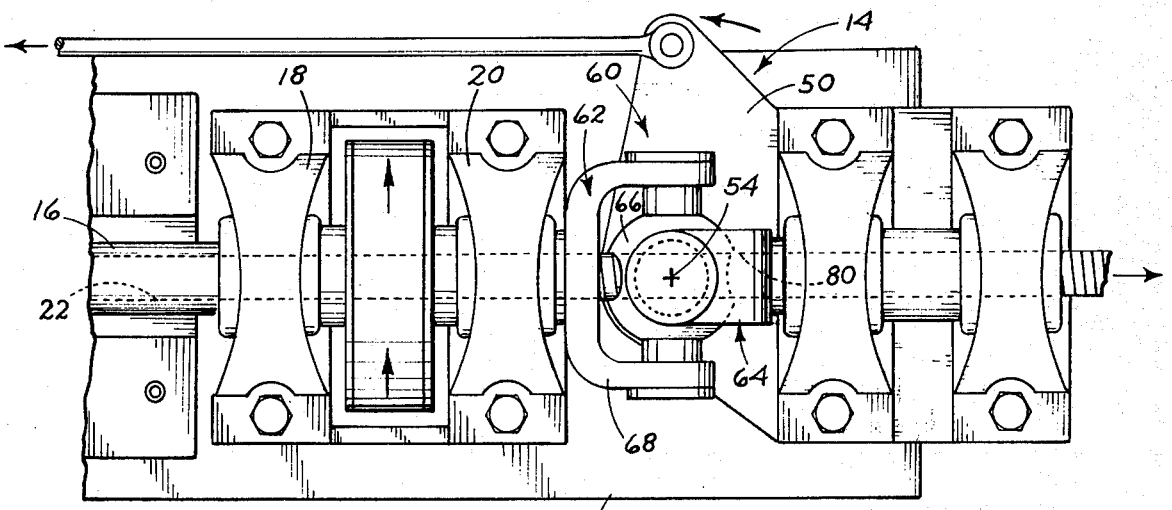
FIG. 7 is a view similar to FIG. 6, but showing the apparatus in a different condition of adjustment and without portions broken away.
Figure 8:
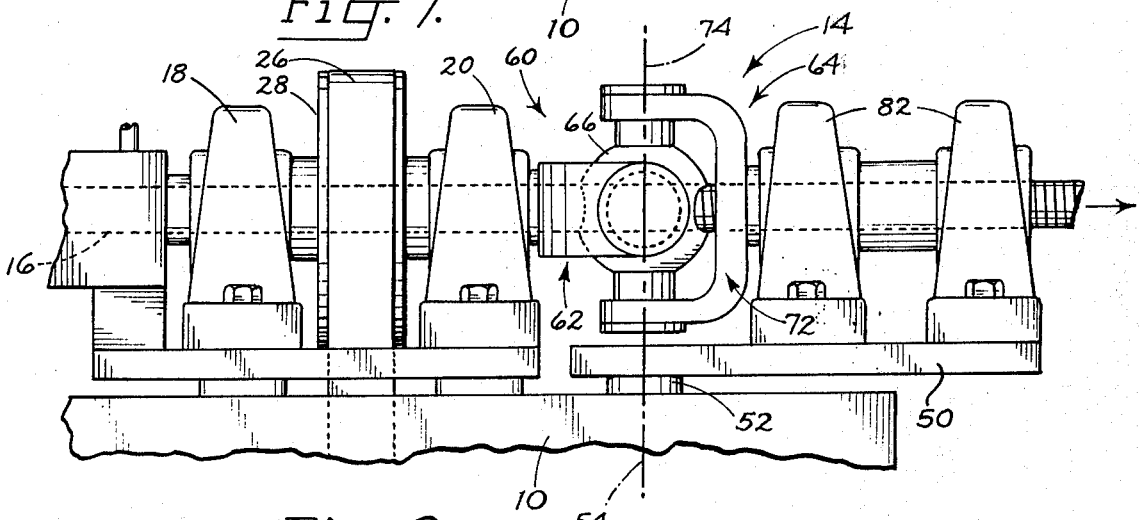
FIG. 8 is a side elevation of the apparatus as illustrated in FIG. 7.

Considering details of the means 14 forming a bending station in the apparatus, and referring now more particularly to FIGS. 6, 7 and 8, mounted for pivotal movement in a horizontal plane above the top of frame 10 is a mounting plate 50. Pivotal movement is afforded by pivot means 52 which journals the mounting plate for pivotal movement about a vertical axis indicated at 54.

Indicated generally at 60 is universal mechanism including what is referred to herein as an infeed part 62, an outfeed part 64, and a centrally located confining member 66, the infeed and outfeed parts being pivotally mounted on the confining member 66 for relative universal movement of the infeed and outfeed parts.

More specifically, infeed part 62 comprises a clevis 68 with arms that straddle and at their extremities are journaled on central confining member 66, whereby the confining member and clevis are pivotable relative to each other about an axis 70. Outfeed part 64 includes a clevis 72 with arms that straddle and at their extremities are journaled on the confining member for relative pivotal movement about an axis 74 (see FIG. 8), which is normal to and intersects axis 70. The point of intersection of these axes is aligned with axis 54 which is the swing axis of the mounting plate.

Clevis 68 is joined to the end of cylinder or mounting 16, and has a bore 76 therein which is a continuation of bore 22 in mounting 16.

Joined to clevis 72 is a shank portion 78. The clevis and shank portion are provided with a bore 80 extending along the axis of the shank portion which bore has the same diameter as bore 22 earlier described. Clevis 72 and shank portion 78 are mounted for rotation about an axis coinciding with the axis of bore 80, through bearings mounted on mounting plate 50 by pillow blocks 82.

Confining member 66 is provided with a passage 86 extending therethrough, which a work element advances through when passing through the bending station. This passage, and as can be seen in FIG. 6, in a plane which is normal to axis 74, has an opened flaring mouth (indicated at 86*a* in FIG. 6) which faces to the right in FIG. 6 from the point of intersection of axes 70, 74. The flaring mouth described permits clevis 72 and the outfeed part to assume different positions with respect to confining member 66, with any work element being processed presented an unobstructed path progressing from the point of intersection of axes 70, 74 along the axis of bore 80. Passage 86 in this plane has uniform width, in a portion 86*b* which extends to the left in FIG. 5 from the point of intersection of axes 70, 74.

Figure 9:
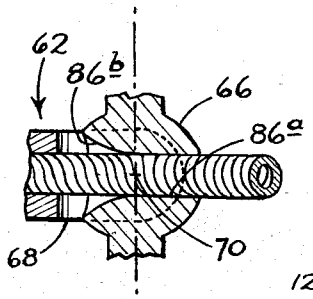
FIG. 9 is a cross-sectional view, taken generally along the line 9—9 in FIG. 6.

As best seen in FIG. 9, in a plane which is normal to axis 70, portion 86*b* of the passage has an open flaring mouth which faces to the left from the point of intersection of axes 70, 74. This mouth affords unobstructed movement of the work element into member 66 with clevis 68 assuming different positions relative to the member 66. In this plane, portion 86*a* of the passage has uniform width.

Figure 3:
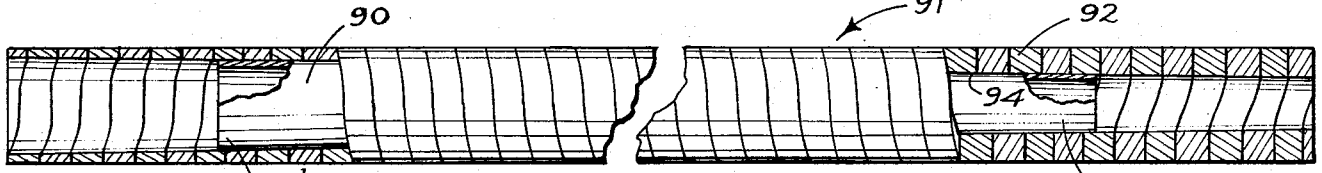
FIG. 3 illustrates, with portions broken away, a sheathing device as contemplated by the invention, and a tapered work element, more specifically a tube, mounted within said sheathing device.

Referring now to FIG. 3, a work element of the type that may be processed with the apparatus of the invention is shown at 90. In the instant case, such comprises an elongate tapered tube, having a small diameter end at 90*a* and a large diameter end at 90*b*. As contemplated by this invention, the work element is housed within a sheathing device 91 before being processed, with such sheathing device having a substantially cylindrical outer profile. In this way an assembly is produced, comprising the sheathing device and the internally mounted work element, which has a uniform outer diameter along its length. Considering the assembly as a whole, problems of properly confining the assembly, such as are introduced when handling a tapered article, are eliminated, because of the uniform diameter which exists along the length of the total assembly.

The sheathing device illustrated comprises an elongate coiled spring element 92. While the outer profile of the coiled spring element is cylindrical, passage 94 which extends axially along the interior of the spring element has a tapered profile, the tapered profile of passage 94 substantially matching the tapered outer profile of work element 90. This enables the work element or tube to be inserted into place within spring element 92, to produce the assembly shown in FIG. 3, comprising the sheathing device snugly encompassing the work elememt of tapered profile. The outer diameter of the assembly, i.e., the outer diameter of the sheathing device, is such that it is snugly receivable within bore 22.

Referring now again to FIGS. 1 and 2, shown journaled on frame 10 are a series of rollers 100. The rollers provide rolling support for a cam plate shown at 102. The cam plate, through connection 104, is joined to crosspiece 44 which is moved by rams 40, 42. As a consequence, actuation of the rams produces movement of the cam plate.

Riding on the upper cam surface of the cam plate is a follower 106 rotatably mounted on an arm 108 secured to one end of a shaft 110 which is journaled under rail members 37, 39. The opposite end of this shaft is secured to another arm 112 which is linked through link 114 to mounting plate 50. With the construction described, on arm 108 lowering in FIG. 2, such causes link 114 to be drawn to the left with pivotal movement of the mounting plate away from the viewer in FIG. 2, or upwardly in FIG. 1.

The assembly which is worked upon, namely the work element, as exemplified by tube 90, and the encompassing sheathing device, is loaded into the apparatus with rams 40, 42 fully extended, and with the arm having the follower occupying the lowered position shown in dashed outline in FIG. 2 at 108A. With this condition of the parts, outfeed part 64 in the universal mechanism is positioned as shown in FIG. 7, i.e., with the bore 80 therein axially aligned with the bore 22 in cylinder or mounting 16. This enables the assembly, comprising the tube and the sheathing device, to be loaded into the device by inserting it through the right end of bore 80 in FIG. 7, with the device passing through the universal mechanism and then being received within bore 22. The assembly is moved back into bore 22 to place the end thereof against pusher mechanism 30.

It will be noted, and with reference to FIG. 4 that the pusher mechanism includes at the end of rod element 31, a well 116 receiving a spring 118 bearing on a plug 120 of larger outer diameter than the inner diameter of tube 90. The plug terminates in a tapered nose 122. The plug is permitted a limited amount of axial play in the end of the rod element by providing a pin 124 with ends mounted in the rod element passing through a diametrically extending slot 126 provided in the plug. The play described is introduced by reason of the fact that slot 126 has a width which exceeds the width of the pin as the slot is viewed in FIG. 4. While the plug is afforded limited movement in an axial direction relative to the rod element, it is keyed to the rod element for rotation therewith. With the assembly comprising the sheathing device and the work element within it moved up against the pusher means, the plug is urged by the spring into snug engagement with the interior of the work element or tube 90, and the sheathing device rests against the end of the rod element. When the mounting or cylinder 16 is rotated through operation of belt 26, the rotation is imparted to the assembly within it by reason of the friction established between the outside of the sheathing device and the inside of bore 22, and further by the frictional contact of the plug with the end of tube 90.

Explaining how the apparatus may be utilized in the straightening of a work element of tapered profile, typically a sheathing device is selected having a length somewhat exceeding the length of the element being straightened, and with the device assembled about the work element the device may extend some 2 inches or so beyond the ends of the element at each end of the assembly. With loading of the assembly comprising the sheathing device and work element (with the apparatus positioned as shown in FIG. 7 whereby bore 80 is aligned with bore 22), the assembly is positioned with one end of the sheathing device within bore 80, and with the adjacent end of the work element within it (which is the smaller diameter end) somewhat to the left of axis 54. The opposite end of the assembly with the larger diameter end of the work element is against the pusher means.

It will be noted, and with reference to FIG. 2, that the camming surface or edge of the cam plate which has follower 106 riding thereagainst, progressing from right to left in FIG. 2, slopes upwardly at a sharp angle initially, thence slopes downwardly at a more gradual angle, and finally falls off sharply. As a consequence, with contraction of rams 40, 42 from a fully extended position, the effects of the construction is initially to shift the mounting plate 50 relatively sharply, whereby it swings to its maximum angle relative to the axis of cylinder 16, i.e., the position shown in FIG. 1. With the follower riding on the more gradually inclined surface of the cam plate, the mounting plate then swings gradually back, to move shank portion 78 of the outfeed part more and more into alignment with cylinder 16. With the rams fully contracted, the follower drops down and the shank portion becomes aligned with the cylinder. The profile of the camming edge in the cam plate is selected so that the maximum angle discussed is reached with initial working of the tube within the sheathing device, this angle gradually decreasing as larger and larger diameter portions of the tube pass over axis 54.

With the sheathing device and tube mounted within cylinder 16 and before the rams are contracted, rotation of the cylinder and universal mechanism is started through powering movement of belt 26. In the processing of the assembly comprising the sheathing device and tapered tube within it, this rotation is maintained as the pusher means gradually advances the assembly through the universal mechanism. The effect of this is to bend the tapered tube back and forth across its axis as such progresses through the universal mechanism, and the amount of such bending gradually decreases as the larger diameter portions of the tube approach the universal mechanism. In other words, the degree of bend imparted to the work element as such progresses through the bending station is varied as the work element progresses, and this variation is coordinated with the advance of the work element, by the inclusion of the means interconnecting the means for advancing the work element and the means forming the bending station, namely, the cam plate, follower and associated structure.

During the straightening operation in the bending station, the infeed part with its bore 76 and aligned bore 22 support the assembly while the same is rotating with the axis of the assembly and the element within it assuming a first orientation, which (with reference to FIG. 1 and 2) is horizontal and coincides with the axis of bore 22. The offbearing part with its bore 80 supports the assembly with the axis thereof assuming a second orientation, which second orientation is also in a horizontal plane. In this horizontal plane, this second orientation defines an angle with the first described orientation, and the angle defined in this horizontal plane is adjusted through adjustable movement of the mounting plate 50 and the outfeed part which it supports.

The sheathing device, as already discussed, imparts a uniform diameter to the assembly which extends throughout its length. By imparting to the assembly a uniform diameter, problems of having to make adjustments to accommodate a taper in order properly to confine the element worked upon are eliminated. The sheathing element also tends to keep the work element from flattening. It will be noted that the sheathing device together with the work element is subjected to a bending action as such passes through the bending station. The sheathing device, however, by reason of its coiled spring construction does not accept a permanent bend on passing through the bending station, and can be used again and again in the production of straightened tubing.

The assembly, comprising the sheathing device and the tube within it, on passing through the universal mechanism tends to impart forces to the parts in the mechanism whereby outfeed part 64 seeks alignment with cylinder or mounting 16, this creating a biasing action which urges follower 106 downwardly on the camming edge of plate 102. If desired, this biasing action can be augmented by a spring or other device.

It should be obvious from the above that the apparatus contemplated has a number of unique advantages over straightening devices known in the art. The claims below define the invention and embrace such modifications and variations as would be apparent to one skilled in the art.

It is claimed and desired to secure by letters patent:

1. Straightening apparatus comprising advancing means for advancing an elongate work element while rotating the same about its longitudinal axis, means forming a bending station in said apparatus, operable as the work element progresses through the station, to bend the work element across the longitudinal axis thereof, and means operatively interconnecting the means for advancing the work element and the means forming the bending station operable to vary the degree of bend imparted to the work element by the means forming the bending station as the work element is advanced by the advancing means.

2. The apparatus of claim 1, wherein the means for advancing the work element comprises an elongate mounting having a bore defined therein which receives the element, means for rotating the mounting about an axis coinciding with the axis of said bore, and power-operated pusher means advanceable through said bore and operable to push the element to advance the same through said bore.

3. The apparatus of claim 2, wherein the apparatus further comprises an elongate sheathing device having a passage extending axially along the interior thereof for the reception of the work element, said sheathing device fitting within said bore and being advanced by said pusher means together with said work element, said sheathing device having a construction which inhibits the production of a permanent bend therein by the action of the bending station.

4. The apparatus of claim 3, wherein said sheathing device comprises an elongate coiled spring.

5. Straightening apparatus comprising advancing means for advancing an elongate work element while rotating the same about its longitudinal axis, and means in the path of said work element forming a bending station in said apparatus, said means forming the bending station comprising an infeed part having a passage extending therethrough for the reception of the work element adapted to support the work element while the same is rotating about its longitudinal axis with the axis of the element assuming a first orientation in said apparatus, and an outfeed part having a passage extending therethrough for the reception of the work element while the same is rotating about its longitudinal axis with the axis of the work element assuming a second orientation in said apparatus, said first and second orientations occupying a plane in said apparatus and defining an angle in said plane, one of said parts in said means forming a bending station being mounted for adjustable movement in the apparatus to adjust the angle in said plane defined by said first and second orientations, the advancing means being operatively connected to the means forming a bending station to produce adjustable movement in said one part coordinated with the advance of a work element.

6. Straightening apparatus comprising advancing means for advancing an elongate work element while rotating the same about its longitudinal axis, and means in the path of said work element forming a bending station in said apparatus, said means forming the bending station comprising a universal mechanism including an infeed part, an outfeed part, and a central confining member having said infeed and outfeed parts pivotally connected thereto for relative universal movement, said confining member having a passage therein receiving said work element as the same is advanced through said apparatus, said infeed part being journaled in said apparatus for rotation about one axis which coincides with the axis of the work element as the same advances toward the universal mechanism, said outfeed part being journaled in said apparatus for rotation about another axis which is the axis of the work element as the same leaves the universal mechanism.

7. The straightening apparatus of claim 6, wherein said outfeed part is mounted in said apparatus on an adjustable mounting which is adjustable to change the relative position of the outfeed part and the infeed part, and wherein said advancing means and means forming a bending station are operatively interconnected whereby adjustment in said mounting is produced coordinated with the advance of a work element by said advancing means.

8. In straightening apparatus for straightening a tapered work element, a sheathing device having a substantially cylindrical outer profile, an elongate passage extending axially through the interior of said sheathing device for the reception of the work element, said passage having a tapered profile substantially matching the tapered profile of the work element, advancing means for advancing the sheathing device together with any work element received therein with such advancing being accompanied with rotation of the sheathing device about its longitudinal axis, and means in the path of said sheathing device for imparting straightening to a work element received by said sheathing device.

9. The apparatus of claim 8, wherein said sheathing device comprises an elongate coiled spring element.

10. Straightening apparatus comprising advancing means for advancing an elongate work element while rotating the same about its longitudinal axis, and means in the path of said work element forming a bending station in said apparatus, said means forming the bending station comprising a rotatable infeed part having a passage extending therethrough for the reception of the work element adapted to support the work element while rotating with the work element and with the axis of the element assuming a first orientation in said apparatus, a rotatable outfeed part having a passage extending therethrough for the reception of the work element adapted to receive the same while rotating with the work element about an axis which assumes a second orientation in said apparatus, said first and second orientations occupying a plane and intersecting to define an angle in said plane, said infeed and outfeed parts each being pivotally connected to a central confining member whereby the same are pivotally interconnected for relative universal movement through said confining member, said confining member having a passage extending therethrough which receives said work element where said orientations intersect to define an angle.

* * * * *